US005331709A

United States Patent [19]

Hudson

[11] Patent Number: 5,331,709

[45] Date of Patent: Jul. 26, 1994

[54] APPLICATOR FOR APPLYING PAINT TO LATTICE WORK

[76] Inventor: C. Leonard Hudson, 2234 Brookwood Dr., SE., Decatur, Ala. 35601

[21] Appl. No.: 30,735

[22] Filed: Mar. 12, 1993

[51] Int. Cl.[5] ..... B05C 17/00; A47L 13/46

[52] U.S. Cl. ..... 15/176.6; 15/244.1

[58] Field of Search ..... 15/176.1, 176.6, 229.11, 15/229.13, 145, 209.1, 210.1, 211, 244.1-244.4; 401/9

[56] References Cited

U.S. PATENT DOCUMENTS

| | | | |
|---|---|---|---|
| D. 181,211 | 10/1958 | Lindstrom | 15/244.1 X |
| 2,163,638 | 6/1939 | Vaughn | 15/244.1 |
| 2,321,511 | 6/1943 | Piercy | 15/209.1 X |
| 2,915,768 | 12/1959 | Hall | 15/244.1 |
| 2,975,454 | 3/1961 | Bernstein | 15/244.2 |
| 3,054,127 | 9/1962 | Petsch et al. | 15/244.1 |
| 3,131,419 | 5/1964 | Vosbikian et al. | 15/244.1 X |
| 3,137,880 | 6/1964 | Kubit et al. | 15/210.1 X |
| 3,412,416 | 11/1968 | Simon | 15/244.1 X |
| 3,570,038 | 3/1971 | Jones | 15/244.1 |
| 4,674,144 | 6/1987 | Palmeri | 15/210.1 |

FOREIGN PATENT DOCUMENTS

| | | | |
|---|---|---|---|
| 761756 | 11/1956 | United Kingdom | 15/230.11 |

*Primary Examiner*—Stephen F. Gerrity
*Assistant Examiner*—Charles Cooley
*Attorney, Agent, or Firm*—John C. Garvin, Jr.

[57] ABSTRACT

An applicator for applying paint to the internal walls of generally square or diamond shaped openings in articles such as lattice work. The applicator comprises a handle, a generally frusto-pyramoidal (pyramid-shaped with the top cut out) paint pad mounted on and secured to one end of the handle. The frusto-pyramoidal paint pad includes a four sided base, a four sided top, and four sloped or tapered side walls for applying paint to the internal walls of openings in articles such as lattice work. The paint pad of a second embodiment incorporates an upstanding shoulder extending from the pad adjacent the four sided base which also applies paint to the article (lattice work) in an area surrounding the openings.

4 Claims, 1 Drawing Sheet

APPLICATOR FOR APPLYING PAINT TO LATTICE WORK

FIELD OF THE INVENTION

This invention relates to applicators for paint and other liquids and more specifically to a paint applicator for applying paint to the walls of generally square openings (as well as openings of other shapes) in articles such as lattice work.

BACKGROUND OF THE INVENTION

Applicators of various construction are available for applying paint to various objects. These applicators are of various shapes, designs and sizes and include paint brushes with bristles and foam rubber; rollers having various materials thereon for applying paint to various articles; and spray painting apparatuses. Available applicators, can be used to paint the square openings of conventional lattice work, but the use of such applicators for such purpose is extremely tedious, time consuming, costly, messy or require substantial experience.

In the field of applicators for applying paint to the square openings in lattice work, there has been a longfelt need for a simple applicator that an inexperienced person could use which would have a brush head that would allow greater amounts of paint to be loaded on the applicator and reduce the time and tediousness associated with applying paint to lattice work, particularly the walls of the numerous openings in the lattice work.

SUMMARY OF THE INVENTION

The instant invention relates to a paint applicator, which is relatively simple and inexpensive in construction, capable of being used by a relatively inexperienced person to apply paint to the walls of square shaped or other shaped openings in articles such as lattice works, satisfies a longfelt need, and overcomes the several deficiencies, disadvantages and drawbacks of prior art devices. The paint applicator of a first embodiment of the instant invention comprises a handle member, a generally frusto-pyramoidal (pyramid-shaped with the top cut off) paint pad mounted on one end of the handle member, and means for securing the paint pad to the handle member. The paint applicator of a second embodiment of the instant invention differs from that of the first embodiment only in that paint pad incorporates a base plate having an upstanding shoulder and which abuts the base of the generally frusto-pyramoidal paint pad. The instant invention allows the rapid and complete application of paint to the walls of the square shaped openings in lattice work and, with the second embodiment, the application of paint to the area surrounding the openings.

It is an object of the present invention to provide a paint applicator which is simple and inexpensive in construction for applying paint to the walls of generally square shaped, diamond shaped, or other shaped openings in articles such as lattice work.

It is a further object of the present invention to provide a paint applicator which is simple and inexpensive in construction and capable of use by relatively inexperienced persons for applying paint to the walls of generally square openings in articles such as lattice work.

It is still a further object of the present invention to provide a paint applicator which is simple and inexpensive in construction and use, and capable of being used by relatively inexperienced persons for applying paint to the walls of generally square openings, together with the area surrounding the openings, in articles such as lattice work.

The object as well as other aspects, objects and advantages of the present invention will become apparent to those skilled in the art after reading the following description of the preferred embodiments in conjunction with the accompanying drawings, and the appended claims.

DETAILED DESCRIPTION OF THE INVENTION

Figure 1:
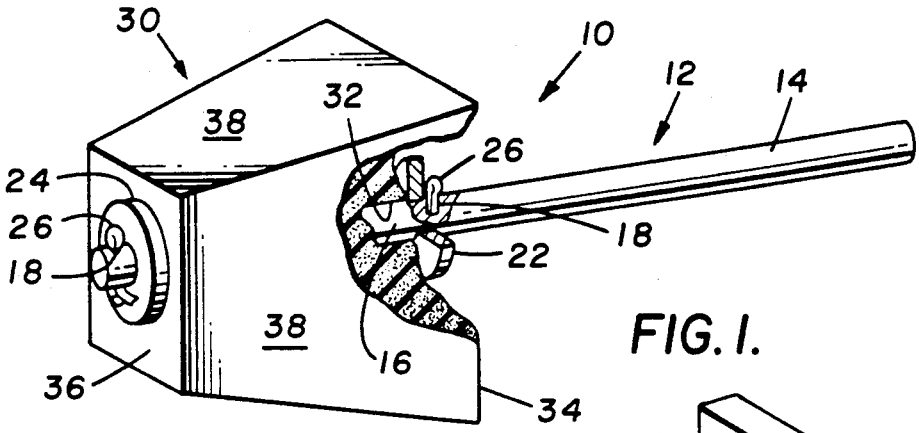
FIG. 1 is a perspective, partially broken away view showing a first embodiment of the paint applicator of the present invention.
Figure 5:
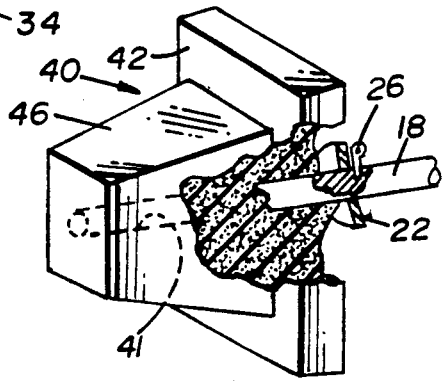
FIG. 5 is a perspective, partially broken away, view showing the means for mounting and securing the paint pad on the handle member for the embodiment illustrated in FIGS. 2 and 3.
Figure 4:
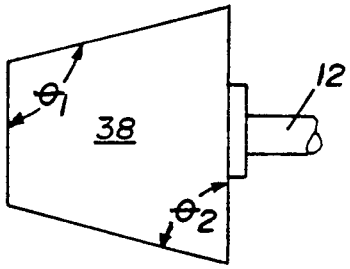
FIG. 4 is an elevational view of the paint pad illustrating the angular relation between the planar sides, planar top surface and planar base surface.

Throughout the description which follows, like reference numerals will normally be used to indicate the same or like parts. Referring now to drawings, FIG. 1 illustrates, by way of example, the first embodiment of the present invention. Reference numeral 10 generally designates the paint applicator of the present invention. Paint applicator 10 comprises a handle member 12 including a gripping section 14, a paint pad mounting section 16 with a pair of spaced transverse bores 18 therein which define the outer boundaries of paint pad mounting section 16; a first washer 22; a frusto-pyramoidal paint pad 30; a second washer 24; and a pair of cotter pins 26. Paint pad 30 comprises an internal bore 32, a four-sided base 34 having a planar surface, a four-sided top 36 having a planar surface, and four sloped or tapered side walls 38, each of which has a planar surface which extends between the four sided base 34 and top 36. Each sloped side wall 38 forms an acute angle with respect to the planar surface of four-sided base 34 as represented by the angle $\theta_2$ in FIG. 4 and an obtuse angle with respect to the planar surface of four-sided top 36 as represented by the angle $\theta_1$ in FIG. 4. Paint applicator 10 is assembled by inserting one of the cotter pins 26 in the transverse bore 18 of handle member 12 adjacent the gripping section 14 of handle member 12, placing first washer 22 onto the paint pad mounting section 16 of handle member 12, sliding paint pad 30 over and onto paint pad mounting section 16 of handle member 12, placing second washer 24 onto paint pad mounting section 16 of handle member 12, inserting the second cotter pin 26 into the other of transverse bores 18, and bending the free ends of each of the cotter pens 26 to secure first washer 22, paint pad 30 and second washer 24 onto the paint pad mounting section 16 of handle member 12.

Figure 2:
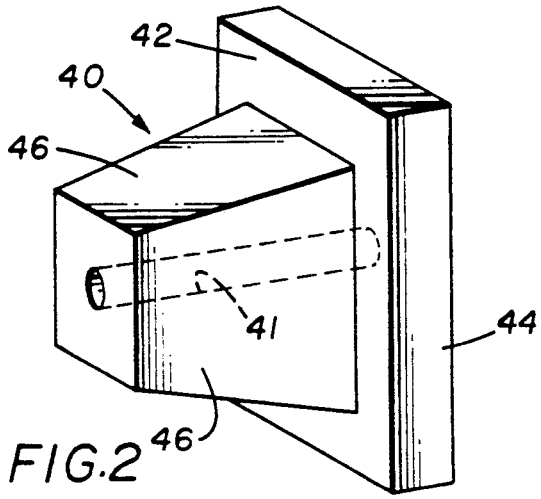
FIG. 2 is a perspective view of the paint pad used in a second embodiment of the paint applicator of the present invention.
Figure 3:
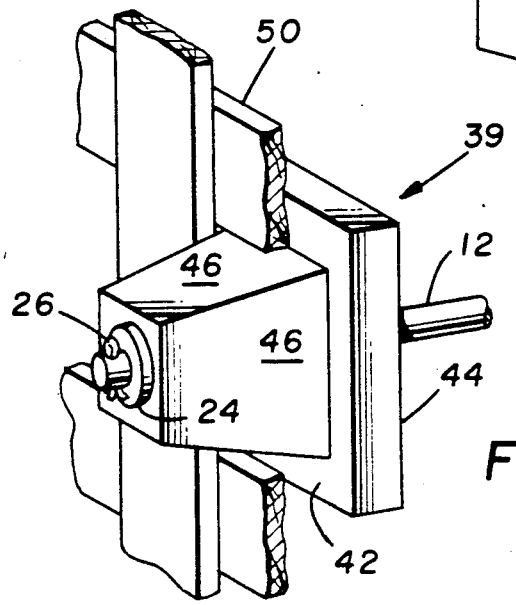
FIG. 3 is a perspective view of the second embodiment of the present invention shown with partially broken away lattice work.

The second embodiment of the present invention as depicted in FIGS. 2 and 3 differs from the embodiment depicted in FIG. 1 only in that the paint pad 40 incorporates a base plate 44 which abuts the planar surface of base 34 and which has an upstanding shoulder surface 42, and the planar surfaces of four-sloped walls 46 stop at upstanding shoulder surface 42. Reference numeral 50 (FIG. 3) generally designates conventional lattice work.

The handle member 12 may be made of any suitable material such as wood, plastic, metal or fiber glass. The paint pads 30 and 40 may be made of any suitable absorbent, resilient material, such as sponge rubber or open-cell polyurethane foam.

When using the embodiment of the invention depicted in FIG. 1, a user merely has to grasp gripping section 14 of handle member 12 and dip paint pad 30 into a container of paint, possibly remove a small amount of the paint from its side walls 38, insert the top 36 into an opening in the lattice work until the side walls 38 firmly engage the inner walls of the openings in the lattice work to apply paint to the inner walls of the lattice work, and then withdraws the paint pad 30 from the opening in the lattice work. The insertion and withdrawal of paint pad 30 can be accomplished several times before it becomes necessary to dip paint pad 30 back into the container of paint. The embodiment of the invention depicted in FIGS. 2 and 3 is used similarly, however paint, when pad 40 is dipped, is also absorbed by upstanding shoulder 42 to enable the shoulder 42 to apply paint to the area of the lattice work 40 which surrounds each opening of the lattice work 50. After painting a number of inner walls and/or surrounding areas, the user will touch up the lattice work with a conventional paint brush.

While the above description constitutes preferred embodiments of the present invention, it will be appreciated that the invention is susceptible to modification, variation and change without departing form the proper scope and fair meaning of the accompanying claims. For example, the sides of the paint pads may be round, octagonal, diamond, or of other shapes or configurations to paint the internal walls of openings other than square-shaped.

I claim:

1. An applicator for applying paint to the internal walls of generally square shaped openings in an article, said applicator comprising:

a handle member including a gripping section and a paint pad mounting section;

a generally frusto-pyramoidal shaped, flexible, paint pad including a planar base surface, a planar top surface, and four sloped planar side walls, each of said side walls extending between and connecting said planar base surface and said planar top surface, said paint pad being made of an absorbent, resilient material; each of said sloped planar side walls defines an acute angle with respect to said planar base surface and defines an obtuse angle with respect to said planar top surface; and means for removably and replaceably mounting and securing said paint pad on said paint pad mounting section of said handle member with said pad mounting section extending into said pad for secured relation therewith and said gripping section of said handle member extending in exposed relation outside of said planar base surface.

2. The paint applicator of claim 1 wherein said means for mounting and securing said paint pad on said paint pad mounting section of said handle member includes a first transverse opening adjacent said paint pad mounting section of said handle member, a second transverse opening disposed in said handle member adjacent said paint pad mounting section of said handle member, a first cotter pin mounted within said first transverse opening disposed in said handle member adjacent said paint pad mounting section of said handle member, a first washer mounted on said paint pad mounting section of said handle member between said first cotter pin and said planar base surface of said paint pad, a second washer mounted adjacent said paint pad mounting section of said handle member between said top of said paint pad and said second transverse opening in said paint pad mounting section of said handle member, and a second cotter pin mounted within said second transverse opening and in engagement with said second washer.

3. An applicator for applying paint to the internal walls of generally square shaped openings in an article and areas surrounding said generally squared shaped openings in said article, said applicator comprising:

a handle member including a gripping section and a paint pad mounting section;

a generally frusto-pyramoidal shaped paint pad including a four sided planar base surface, a four-sided planar top surface, a base plate having an upstanding shoulder extending beyond the planar base surface, said base plate being provided with a planar surface parallel with and abutting said planar base surface, four sloped side walls having planar surfaces extending between and connecting said planar base surface and said planar top surface, each of said planar surfaces of said sloped side walls defining an acute angle with respect to said planar base surface and defining an obtuse angle with respect to said planar top surface, said paint pad being made of an absorbent, flexible, resilient material; and means for removably and replaceably mounting and securing said paint pad on said paint pad mounting section of said handle member.

4. The paint applicator of claim 3 wherein said means for mounting and securing said paint pad on said paint pad mounting section of said handle member includes a first transverse opening disposed in said handle member adjacent said paint pad mounting section of said handle member, a second transverse opening disposed in said handle member adjacent said paint pad mounting section of said handle member, a first cotter pin mounted within said first transverse opening adjacent said paint pad mounting section of said handle member, a first washer mounted on said paint pad mounting section of said handle member between said first cotter pin and said base plate of said paint pad, a second washer mounted adjacent said paint pad mounting section of said handle member between said planar top surface of said paint pad and said second transverse opening in said paint pad mounting section of said handle member, and a second cotter pin mounted within said second transverse opening and in engagement with said second washer.

* * * * *